US006978747B2

(12) United States Patent
Yager et al.

(10) Patent No.: US 6,978,747 B2
(45) Date of Patent: Dec. 27, 2005

(54) HYDRAULIC ACTUATOR CARTRIDGE FOR A VALVE

(75) Inventors: James H. Yager, St. Charles, IL (US); Ning Lei, Oak Brook, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 2 days.

(21) Appl. No.: 10/404,482

(22) Filed: Apr. 1, 2003

(65) Prior Publication Data

US 2004/0194744 A1 Oct. 7, 2004

(51) Int. Cl.[7] ..... F01L 9/02

(52) U.S. Cl. ..... 123/90.12; 123/90.13; 123/90.16

(58) Field of Search ..... 123/90.12, 90.13, 123/90.15, 90.22, 90.23, 90.24, 90.45, 90.46, 123/90.48, 90.49, 90.52, 90.55; 91/170 R, 91/172, 182, 183

(56) References Cited

U.S. PATENT DOCUMENTS

| | | | | |
|---|---|---|---|---|
| 3,209,737 A | * | 10/1965 | Omotehara et al. | 123/90.12 |
| 4,502,425 A | | 3/1985 | Wride | |
| 4,656,976 A | | 4/1987 | Rhoads | |
| 4,892,067 A | | 1/1990 | Paul et al. | |
| 4,901,684 A | | 2/1990 | Wride | |
| 5,002,022 A | | 3/1991 | Perr | |
| 5,012,778 A | | 5/1991 | Pitzi | |
| 5,224,683 A | | 7/1993 | Richeson | |
| 5,248,123 A | | 9/1993 | Richeson et al. | |
| 5,287,829 A | | 2/1994 | Rose | |
| 5,339,777 A | | 8/1994 | Cannon | |
| 5,410,994 A | | 5/1995 | Schechter | |
| 5,419,301 A | | 5/1995 | Schechter | |
| 5,421,359 A | | 6/1995 | Meister et al. | |
| 5,448,973 A | | 9/1995 | Meyer | |
| 5,456,221 A | | 10/1995 | Schechter | |
| 5,456,222 A | | 10/1995 | Schechter | |
| 5,456,223 A | | 10/1995 | Miller et al. | |
| 5,529,030 A | | 6/1996 | Rose | |
| RE35,303 E | | 7/1996 | Miller et al. | |

(Continued)

FOREIGN PATENT DOCUMENTS

DE 10143959 A1 * 3/2003 ..... F01L 9/02

*Primary Examiner*—Thomas Denion
*Assistant Examiner*—Ching Chang
(74) *Attorney, Agent, or Firm*—Dennis Kelly Sullivan; Susan L. Lukasik; Jeffrey P. Calfa

(57) ABSTRACT

A valve actuator for controlling a valve between an open and a closed disposition includes couplings to a source of fluid under pressure and a reservoir at substantially ambient pressure. A control fluidly coupled to the source of fluid under pressure and to the reservoir for controlling presenting fluid at selected pressure to affect a reciprocatable component, the reciprocatable component being operably coupled to the valve for shifting the valve between the open and the closed disposition. And, positively, hydraulically shifting the valve between the open and the closed disposition. A method of valve actuation is also included.

17 Claims, 6 Drawing Sheets

U.S. PATENT DOCUMENTS

| | | | | |
|---|---|---|---|---|
| 5,595,148 | A | 1/1997 | Letsche et al. | |
| 5,636,602 | A | 6/1997 | Meister | |
| 5,829,397 | A | 11/1998 | Vorih et al. | |
| 5,967,105 | A | 10/1999 | Freeland | |
| 5,970,956 | A | 10/1999 | Sturman | |
| 6,044,815 | A | 4/2000 | de Ojeda | |
| 6,263,842 | B1 | 7/2001 | De Ojeda et al. | |
| 6,338,320 | B1 | 1/2002 | De Ojeda | |
| 6,763,790 | B2 * | 7/2004 | Watson et al. | 123/90.12 |
| 6,857,403 | B2 * | 2/2005 | Diehl et al. | 123/90.12 |
| 2002/0121251 | A1 | 9/2002 | Watson et al. | |
| 2003/0015155 | A1 | 1/2003 | Turner et al. | |
| 2004/0060529 | A1 * | 4/2004 | Nan et al. | |
| 2004/0065283 | A1 * | 4/2004 | Chang | |

* cited by examiner

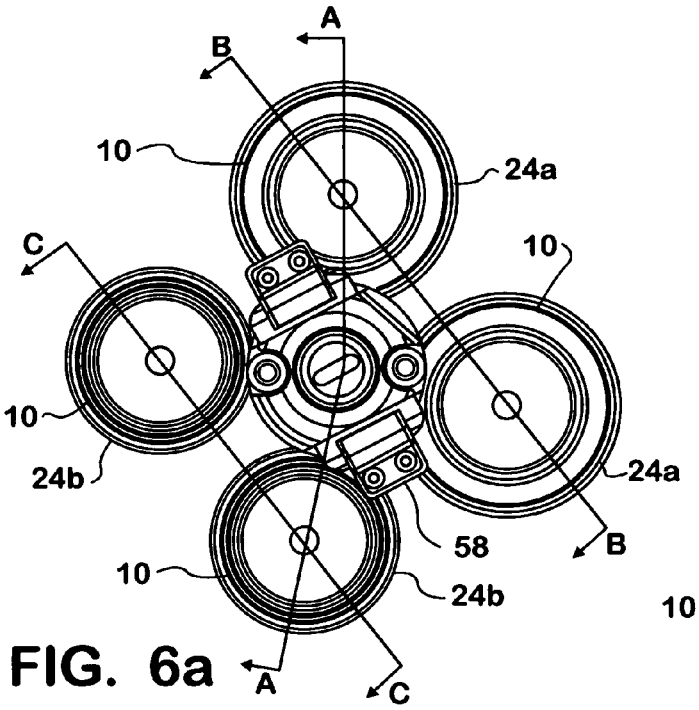
FIG. 6a
FIG. 6d
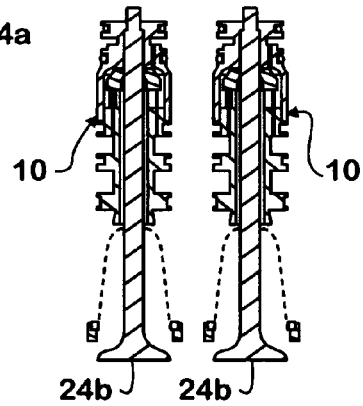
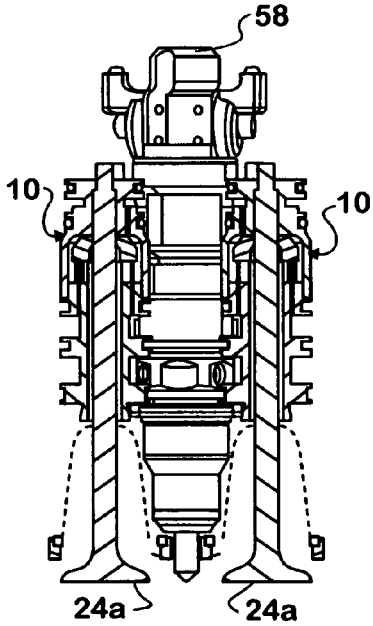
FIG. 6b
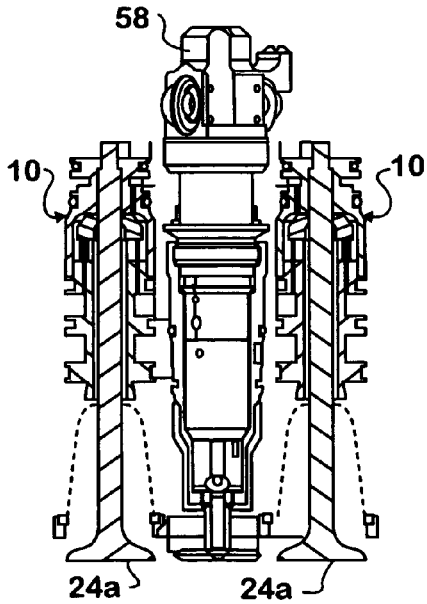
FIG. 6c

HYDRAULIC ACTUATOR CARTRIDGE FOR A VALVE

FIELD OF THE INVENTION

The present invention relates to a valve actuator useful in an internal combustion engine. More particularly, the invention relates to a hydraulic actuator for positively opening and closing an air valve.

BACKGROUND OF THE INVENTION

Presently, engine air valves are actuated by a cam shaft bearing on a poppet type valve stem and opening the valve by action of the eccentric cam lobe bearing on the valve stem acting counter to the bias of a closing valve spring. Closing of the valve is by means of the bias exerted by the valve spring.

The present design involves high mass, takes up significant space, and is limited in the amount of variation in valve opening and closing profile that may be achieved to increase performance and minimize pollutant generation over a wide range of engine operating conditions. There is a need in the industry then to reduce the mass of the valve train, minimize the space occupied by the valve train and increase the flexibility of the achievable variation of the valve opening and closing profile.

SUMMARY OF THE INVENTION

The present invention substantially meets the aforementioned needs of the industry. Valve train mass is substantially reduced along with a significant reduction in the space needed to house the valve train. Significantly, the flexibility of the valve profile to meet the needs of the engine across the full spectrum of engine operating conditions is greatly enhanced.

The advantages of the cartridge design of the present invention include, among others:

- A compact, all-inclusive housing that allows for ease of installation into the engine,
- The design facilitates small hydraulic actuation surfaces in a manner that addresses the usual manufacturing and operational concerns associated with such small actuators; e.g. assembly, mechanical wear, and durability issues,
- The design has reduced parasitic losses associated with the small moving mass,
- The design has reduced hydraulic leakage associated with the use of small-diameter pin-type hydraulic actuators.
- The use of multiple actuation pins allows a stroke-limiting feature to be implemented on a prescribed number of said pins, facilitating further reduction in oil consumption, and therefore, parasitic losses.

The present invention is a valve actuator for controlling a valve between an open and a closed disposition and includes a coupling to a source of fluid under pressure and a coupling to a reservoir at substantially ambient pressure. A control is fluidly coupled to the source of fluid under pressure and to the reservoir for controlling presenting fluid at selected pressure to affect a reciprocatable component, the reciprocatable component being operably coupled to the valve for shifting the valve between the open and the closed disposition. And, positively, hydraulically shifting the valve between the open and the closed disposition. The present invention is further a method of valve actuation.

BRIEF DESCRIPTION OF THE DRAWINGS

FIG. 6*a* is a top planform view of the actuator cartridge of FIGS. 1 and 2 in relation to neighboring components in the engine head;

FIG. 6*b* is a sectional view taken along the section line B—B of FIG. 6*a;*

FIG. 6*c* is a sectional view taken along the section line A—A of FIG. 6*a*; and FIG. 6*b* is a sectional view taken along the section line C—C of FIG. 6*a*.

DETAILED DESCRIPTION OF THE DRAWINGS

Figure 1:
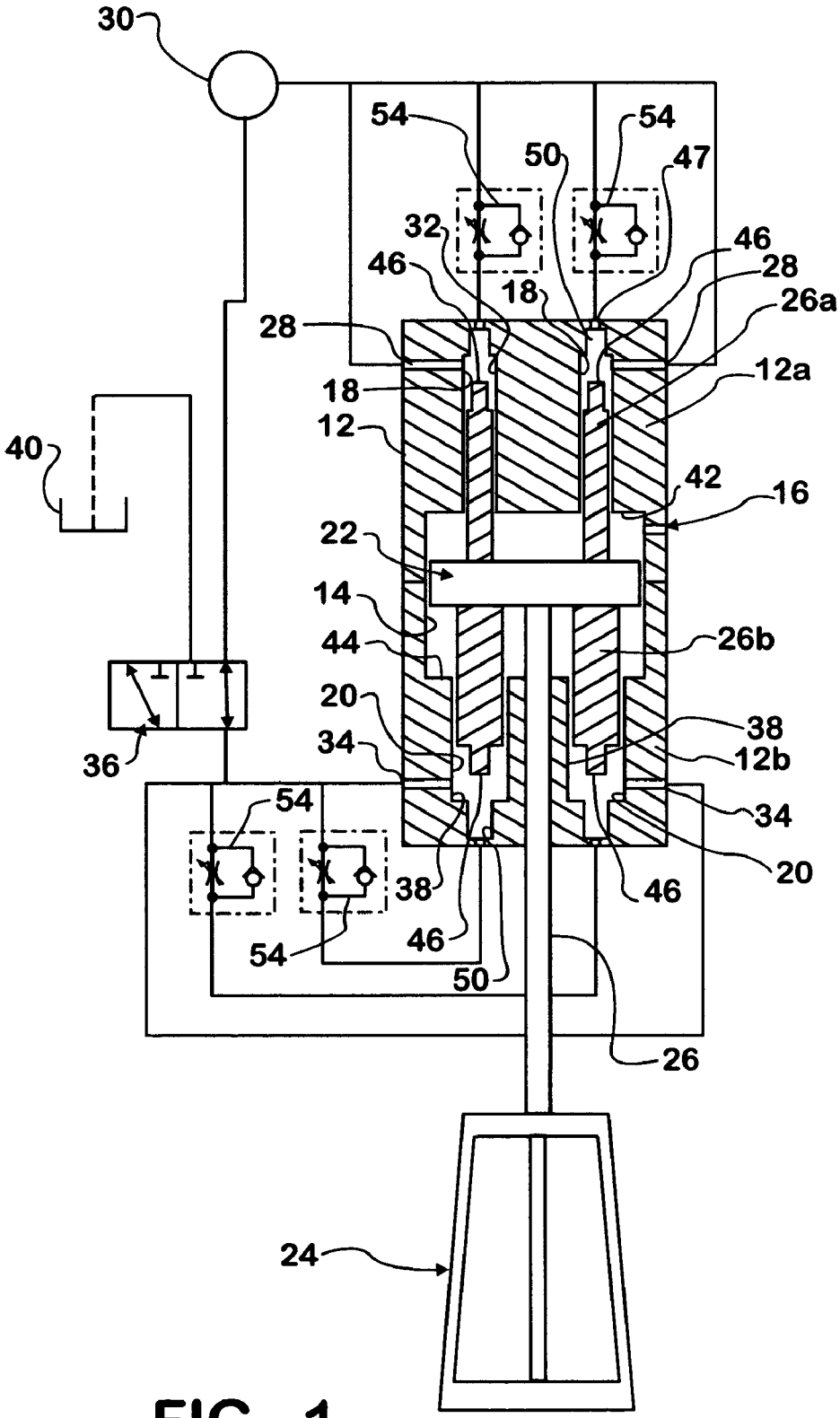
FIG. 1 is a schematic depiction of the actuator cartridge of an embodiment of the present invention.

The actuator cartridge of the present invention is shown generally at 10 in the figures. The actuator cartridge 10 includes a generally cylindrical housing 12 that may include a bottom housing 12*b* mated to a top housing 12*a*. A plurality of fluidly connected bores are defined in the housing 12. The bores include a central push plate bore 14. The push plate bore 14 is fluidly coupled to an area of ambient or near ambient pressure external to the actuator cartridge by a vent 16. A plurality of pin bores, including return pin bores 18 and actuator pin bores 20, are in fluid communication with the push plate bore 14.

A push plate 22 is translatably disposed in the push plate bore 14. The push plate 22 is mechanically attached to one of an array of internal combustion engine air valves 24 by bearing on the upper margin of the valve stem 26. The air valve 24 (in practice, typically an intake or an exhaust valve) may be of the poppet valve design commonly used in internal combustion engines or the retracting seat design, illustrated in FIG. 1 and the subject of co-pending U.S. patent application Ser. No. 09/848516, filed May 3, 2001 incorporated herein by reference. The up-down translatory motion of the push plate 22 in the push plate bore 14 and of the air valve 22 is realized by applying hydraulic force via a multiplicity of cylindrical pins 26 located on opposed sides of the push plate 22, the return pins 26*a* being in contact with the push plate upper margin (return side) and the actuator pins 26*b* being in contact with the push plate lower margin (actuator side). The pins 26 may, or may not be, mechanically attached to the push plate 22. In the present embodiment however, the pins 26 are not mechanically attached to the push plate 22 in order to facilitate ease of assembly of the actuator cartridge 10.

The return pins 26*a* on the return side of the push plate 22 are plumbed via ports 28 directly to a source of high-pressure hydraulic fluid 30, commonly referred to as the 'rail'. The pressure in the return chambers 32 (variable volume chambers 32 are defined in part by the return pin bores 18 and in part by the upper margin of the return pins 26*a*) remains fixed (assuming a constant fluid pressure in the rail 30) throughout the valve event (an event being a shifting of the valve 24 between a closed disposition to an open disposition and return to a closed disposition), providing for a constant downward force on the upper margin of the push plate 22 tending to bias the push plate 22 and the air valve 24 in the closed disposition. It should be noted that the push plate 22 is in the closed disposition when it is at its downwardmost disposition and is open when it is in its upwardmost disposition, corresponding to the open and closed dispositions of the air valve 24.

The actuation pins 26*b* on the actuation side of the push plate 22 are plumbed via ports 34 to a control valve 36, which may preferably be an electronically controlled 2p3w spool valve. The control valve 36 connects either high pressure fluid from the rail 30 to the actuation chambers 38 on the actuation side of the push plate 22 or connects the actuation chambers 38 to the ambient reservoir 40, as desired. The actuation chambers 38 are variable volume being defined in part by the actuation pin bores 20 and in part by the upper margin of the actuation pins 26*b*.

The push plate 22 of the actuator cartridge 10 is constrained to move linearly between two stop limits, upper margin stop 42 of the push plate bore 14 and lower margin stop 44 of the push plate bore 14. The full stroke of the push plate 22 between the two limits approximates the required stroke of the air valve 24. The actuator cartridge 10 typically is of low mass when compared to prior art valve actuators, allowing for rapid actuation of the air valve 24 over the typical range of required air valve 24 motions needed for all operating conditions of the engine.

The number and size of the pins 26 on either side of the push plate 22 are dictated by: (a) dynamic loads, (b) in-cylinder gas loads, and (c) 'sealing' forces required for the particular air valve 24 application. In the present embodiment, the total actuation pin 26*b* wetted surface area (the area exposed to fluid pressure at the distal end 46 of the respective actuation pin 26*b*) exceeds the wetted surface area of the return pins 26*a* (the area exposed to fluid pressure at the distal end 46 of the respective return pin 26*a*), providing a net hydraulic force either up or down, depending on the pressure state of the actuation chambers 38, e.g. whether the chambers 38 are exposed to ambient pressure or to fluid pressure from the rail 30.

In the configuration of FIG. 1, a constant return force on the return side of the push plate 22 generated by the rail pressure in return chambers 32 acting constantly on the wetted surface area exposed to fluid pressure at the distal end 46 of the respective return pin 26*a* is available to close the air valve 24 and to maintain sealing during air valve 24 inactivity.

Seating velocity control for the air valve 24 may be accommodated either by use of a mechanical damping mechanism such as may be used in hydraulic applications, or via the control valve 36. A suitable damping mechanism engages a short distance prior to the actuator impacting the mechanical safety stop (the push plate 22 coming to rest against either stop 42 or 44) in order to reduce actuator velocities at impact.

Figure 2:
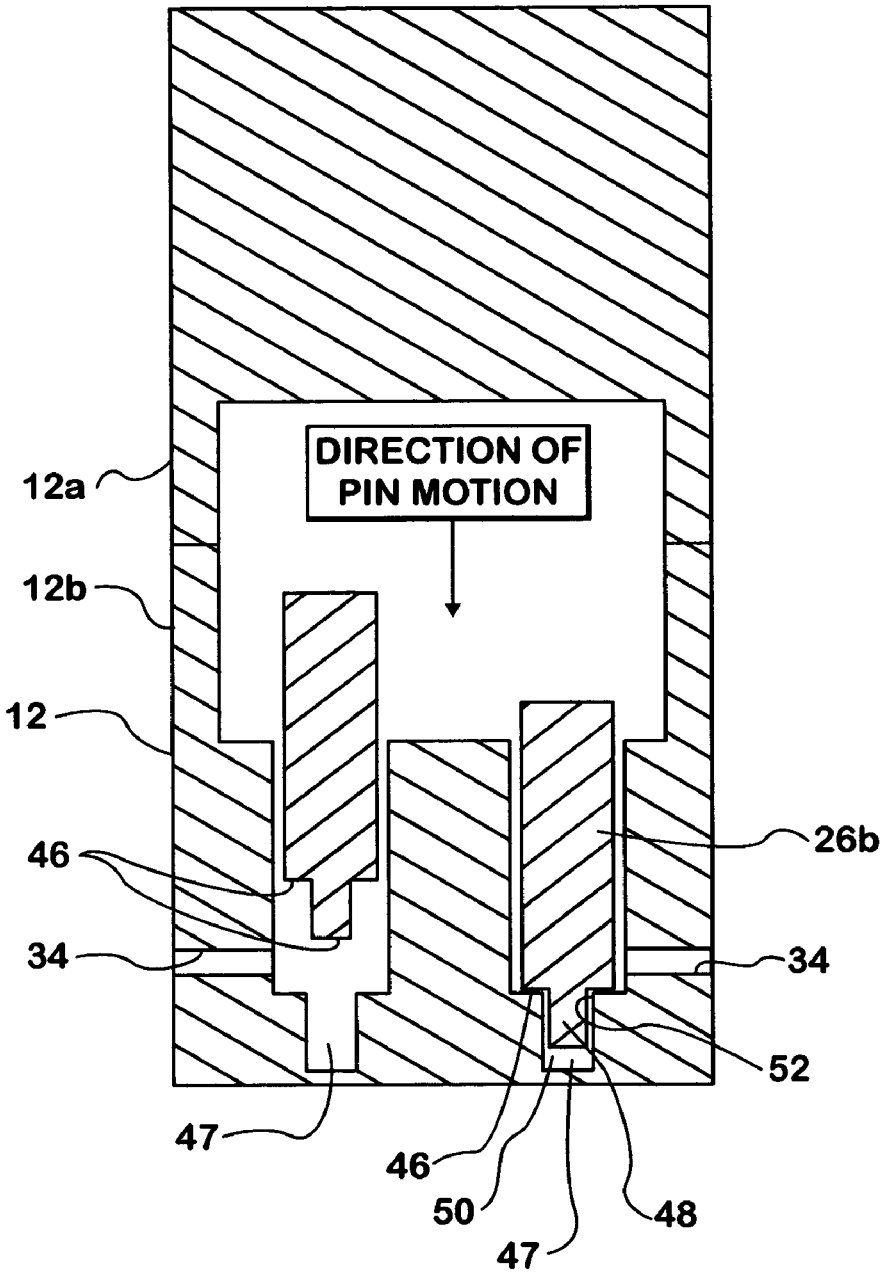
FIG. 2 is a detailed schematic depiction of the function of the mechanical damping mechanism of FIG. 1.
Figure 3:
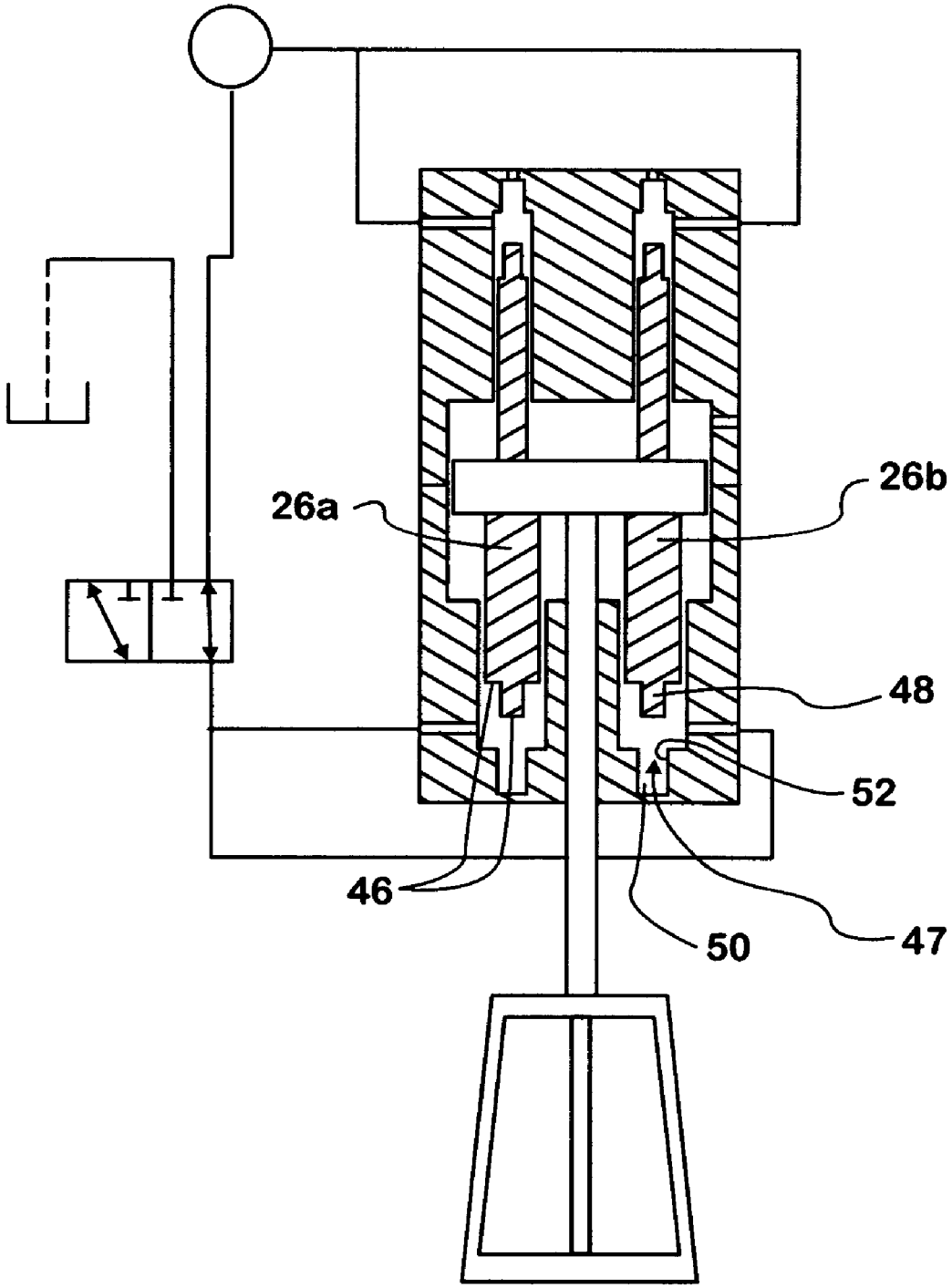
FIG. 3 is a schematic depiction of the actuator cartridge of an embodiment of the present invention without the mechanical damping mechanism of FIGS. 1 and 2.

The specific damping mechanism 47 noted here is depicted in FIGS. 1, 2 and 3. The damping mechanism 47 is comprised of a cylindrical damping tip 48 formed at the distal end 46 of the respective pin 26*a* or 26*b* and a damping well 50 defined by a well housing 52. Preferably, the diameter of the damping tip 48 is slightly less than the diameter of the damping well 50 such that a radical clearance of selected volume is defined between the outer margin of the tip 48 and the wall of the well 50. In this embodiment of the damping mechanism 47 (see the right depiction of FIG. 2), hydraulic fluid is trapped in the volume below the tip 48 and is forced through the radial clearance defined between the tip 48 and the well housing 52. In this way, a sufficient hydraulic 'slowing force' is developed. Prior to engagement, the damping mechanism 47 has no effect on the valve 24 lift profile (see the left depiction of FIG. 2). It is understood in reference to FIG. 2 that in operation of the actuator cartridge 10, the pins 26 always act in concert and would not be disposed as depicted. A similar damping mechanism 47 is provided for both upstroke and down stroke of the actuator cartridge 10, as depicted in FIGS. 1 and 3.

Figure 4:
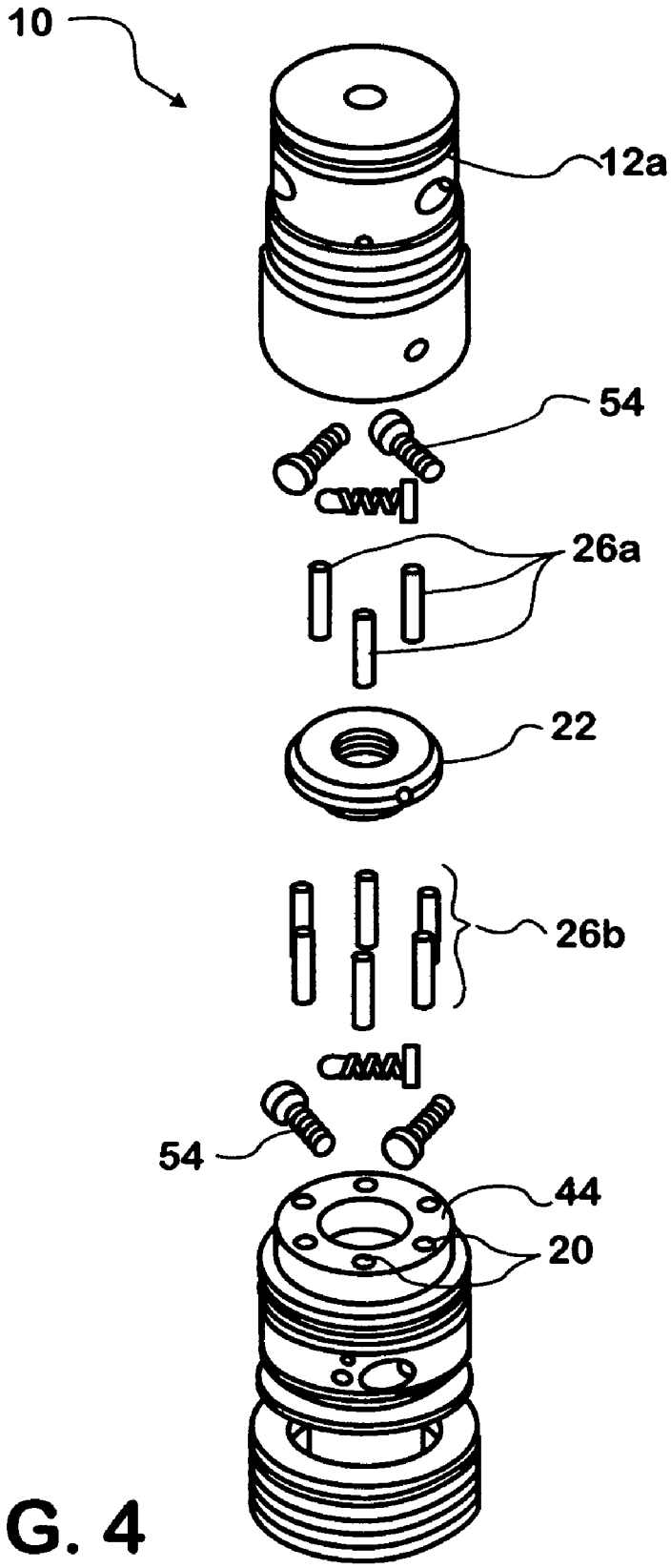
FIG. 4 is an exploded perspective view of the actuator cartridge of FIGS. 1 and 2.

In order to further 'shape' the lift profile produced by the actuator cartridge 10, it may be desirable to accommodate one or more check valves 54 (see FIG. 1) that selectively eliminate the 'ramps' produced by the damping mechanism(s) 47 at start of pin 26 motion. The checks 54 fluidly connect the wells 50 of the return pins 26*a* to the rail 30. The checks 54 fluidly connect the wells 50 of the actuator pins 26*b* to the control valve 26 and are selectively connected to rail 30 or to the ambient reservoir 40. The checks 54 produce a parallel free-flow path into the respective actuation chambers 38 and return chambers 32 as the pins 26 and the push plate 22 move away from their respective hard stops 42, 44 to eliminate the undesired "ramps". Conversely, flow is restricted out of the chamber 32, 38 as the pins 26 approach their respective hard stops in the bottom of the wells 50 to dampen the approach. The checks 54 may be either housed internal to the cartridge 10 (see FIG. 4) or external to the cartridge 10 as depicted schematically in FIG. 1. One or more smaller checks 54 may be used in parallel as depicted in FIG. 4 to facilitate ease of packaging. In the configuration represented in FIG. 1, one or more checks 54 are employed in each direction (return and actuation).

Preferably, the entire assembly of the actuator cartridge 10 is contained within a cylindrical cartridge housing 12 (See FIGS. 4–6*d*.) The cartridge 10 may be, but is not necessarily, pre-assembled and installed on the engine at the combustion deck of the engine head. In the present embodiment, the cartridge housing 12 is in two parts 12*a*, 12*b* in order to facilitate assembly and installation of the reciprocating parts within. These reciprocating parts are comprised of:

Push plate 22,

Engine air valve 24

Pins 26*a*, 26*b* on either side of the push plate 22.

It should be noted in the embodiment of FIG. 4, that the housing 12 is formed of a top housing 12*a* and a bottom housing 12*b* mated together to form the housing 12. Three return pins 26*a* and six actuator pins 26*b* are employed in the actuator cartridge 10 and are not mechanically unitary with the push plate 22. Three checks 54 are utilized in parallel and are connected to the damping mechanisms 47 of the respective return pins 26*a*. Similarly, three checks 54 are utilized in parallel and are connected to the damping mechanisms 47 of the respective return pins 26*a*. The two sets of checks 54 are each preferably disposed in a triangular relationship in the housing 12 transverse to the longitudinal axis of the housing 12.

Figure 5A:
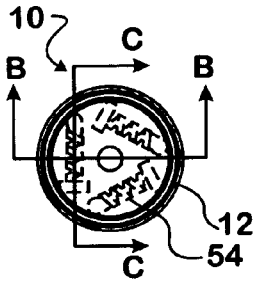
FIG. 5*a* is a top planform view of the actuator cartridge of FIGS. 1 and 2 with the return checks depicted in phantom and the actuator cartridge in the open disposition.
Figure 5B:
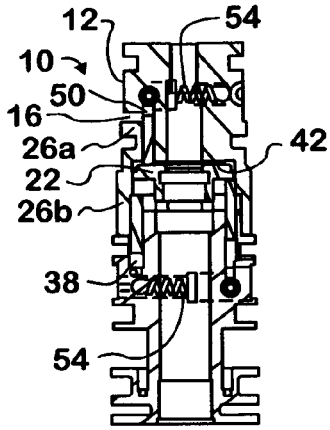
FIG. 5*b* is sectional view of the actuator cartridge taken along the section line B—B of FIG. 5*a;*
Figure 5C:
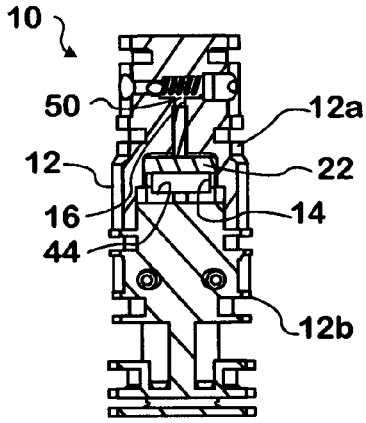
FIG. 5*c* is sectional view of the actuator cartridge taken along the section line D—D of FIG. 5*a;*
Figure 5D:
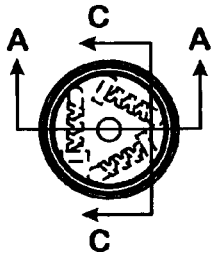
FIG. 5*d* is a top planform view of the actuator cartridge of FIGS. 1 and 2 with the return checks depicted in phantom and the actuator cartridge in the closed disposition.
Figure 5E:
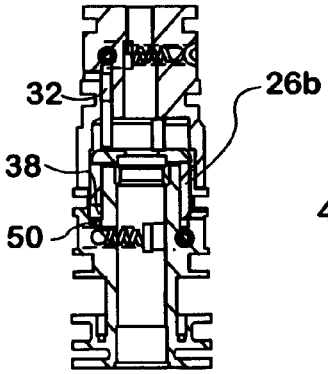
FIG. 5*e* is sectional view of the actuator cartridge taken along the section line A—A of FIG. 5*d;*
Figure 5F:
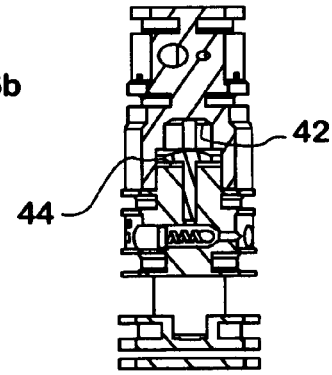
FIG. 5*f* is sectional view of the actuator cartridge taken along the section line C—C of FIG. 5*d;*

FIGS. 5*a*–5*f* depict the actuator cartridge 10 in the open disposition (FIGS. 5*a*–5*c*) and the closed disposition (FIGS. 5*d*–5*f*). In the open disposition, the actuation pins 26*b* are bearing on the actuation side (bottom margin) of the push plate 22. The push plate 22 is forcibly seated on the upper margin stop 42 of the push plate bore 14. The actuation chambers 38 are at their fullest volume and the return pins 26*a* are seated against their stops, the variable volume return chambers 32 being at their smallest volumes. The actuation chambers 38 are in fluid communication with the rail 30 via the control valve 36. Conversely, in the closed disposition, the return pins 26*a* are bearing on the return side (top margin) of the push plate 22. The push plate 22 is forcibly seated on the lower margin stop 44 of the push plate bore 14. The variable volume return chambers 32 are at their largest volume and the actuation pins 26*b* are seated against their stops, the actuation chambers 32 being at their smallest volumes. The actuation chambers 38 are in fluid communication with the ambient reservoir 40 via the control valve 36.

FIGS. 6*a*–6*d* depict an actuator cartridge 10 of the present invention associated with each of four air valves 24 (two intake air valve 24*a* and two exhaust air valves 24*b*) serving a single cylinder. A fuel injector 58 is centrally disposed relative to the respective air valves 24. The great reduction in valve train mass and space occupied by the actuator cartridge 10 of the present invention as compared to the conventional valve train is apparent.

System Operation

At the appropriate time, dictated by engine performance and emissions constraints, the air valve 24 is actuated as follows. The control valve 36 is manipulated in such a way as to connect high-pressure hydraulic fluid form the rail 30 to the actuation cambers 38 via ports 34 on the actuation side of the push plate 22 to bear on the actuation pins 26*b*. (The return pins 26*a* always see high pressure form the rail 30.) In the present embodiment, the hydraulic surfaces on the actuation pins 26*b* are larger than those on the return pins 26*a*. Therefore, when high-pressure is applied to the actuation pins 26*b*, a net force is created which will lift the air valve 24 from its seat against the return bias exerted by the return pins 26*a*.

As the actuation pins 26*b* move away from their hard stops at the bottom of the wells 50, a parallel free flow path from the control valve 36 to the actuation chambers 38 is available via the checks 54 on the actuation side of the actuator 10. The air valve 24 will continue to move in a linear fashion until either commanded to stop by the control valve 36 coupling the actuation chamber 38 to the ambient reservoir 40 or until the actuator (the return pins 26*a* and the push plate 22) impacts a mechanical safety stop 42. As the return pins 26*a* approach their hard stops at the bottom of the damping well 50, their damping mechanism(s) 47 engage (the checks 54 on the return side of the actuator 10 being closed) and the reciprocating parts of the actuator cartridge 10 and air valve 24 will be gently brought to rest by way of a throttled flow through the damping mechanism 47 on the return side of the actuator cartridge 10.

The air valve 24 will remain open until a control signal is sent to the control valve 36. Again, the timing for this event is dictated by engine performance and emissions constraints. This action allows for venting of the hydraulic chambers 38 on the actuation side of the push plate 22 to the ambient reservoir 40. Because the return pins 26*a* always see high pressure from the rail 30, a net force again is created, this time in the opposite direction, which returns the plate 22, and hence the air valve 24, to the original seated closed positions. The function of the check(s) 54 and damping mechanism(s) 47 are the same as for the lifting stroke described above; however roles are reversed for the hardware on the actuation and return sides of the actuator 10.

Design of the stroke-limiting mechanism for the actuator 10 is such that sealing between the air valve 24 and the valve seat (not shown) is ensured when the air valve 24 returns to the initial seated closed disposition.

It will be obvious to those skilled in the art that other embodiments in addition to the ones described herein are indicated to be within the scope and breadth of the present application. Accordingly, the applicant intends to be limited only by the claims appended hereto.

What is claimed is:

1. A valve actuator cartridge being operably coupled to a vavle for effecting shifting of the valve between a closed disposition and an open disposition, comprising:

a housing; and a plurality of reciprocating components translatably disposed in the housing, including a push plate operably coupled to the valve, a hydraulic return device, including a plurality of return actuators being actuatable in concert, the return actuators being operably coupled to a return side of the push plate for effecting translation of the push plate in a return closing direction and a hydraulic actuation device, including a plurality of opening actuators being actuatable in concert, the opening actuators being operably coupled to an actuation side of the push plate for effecting opposing translation of the push plate in an actuation opening direction, the push plate being translatable in a vented push plate bore.

2. The valve actuator cartridge of claim 1, the housing being formed in two portions.

3. The valve actuator cartridge of claim 1, the push plate bore being vented to substantially ambient conditions.

4. The valve actuator cartridge of claim 1, the housing having at least one return bore defined therein for shiftably housing the return device, the at least one return bore intersecting the push plate bore.

5. The valve actuator cartridge of claim 4, the housing having at least one actuation bore defined therein for shiftably housing the hydraulic actuation device, the at least one actuation bore intersecting the push plate bore.

6. The valve actuator cartridge of claim 5, the at least one return bore defining in cooperation with the return device a return chamber, the return chamber being in fluid communication with a source of fluid under pressure.

7. The valve actuator cartridge of claim 6, the at least one actuation bore defining an actuation chamber in cooperation with the hydraulic actuation device, the actuation chamber being selectively in fluid communication with the source of fluid under pressure and fluid at substantially ambient pressure.

8. The valve actuator cartridge of claim 7, the at least one actuation chamber and the at least one return chamber each having a damping mechanism for retarding motion of the respective actuation device and return device in a first direction.

9. The valve actuator cartridge of claim 8, each damping mechanism being fluidly coupled to a check valve for admitting fluid to the respective actuation chamber and return chamber when the respective actuation device and return device is stroking in a second direction.

10. The valve actuator cartridge of claim 8, each damping mechanism being in parallel fluid communication with the fluid communication to the respective actuation chamber and return chamber.

11. The valve actuator cartridge of claim 1, the return actuators being a plurality of return pins being operably coupled to a return side of the push plate.

12. The valve actuator cartridge of claim 11, the return pins being formed unitary with the push plate.

13. The valve actuator cartridge of claim 11, the plurality of opening actuators being a plurality of actuation pins being operably coupled to an actuation side of the push plate.

14. The valve actuator cartridge of claim 13, the actuation pins being formed unitary with the push plate.

15. The valve actuator cartridge of claim 13, the actuation pins having a greater total wetted area affectable by fluid pressure than a total return pin wetted area affectable by fluid pressure.

16. The valve actuator cartridge of claim 13, the actuation pins generating a greater force on the push plate than the return pins generate on the push plate when the actuation pins and the return pins are exposed to substantially equal fluid pressure.

17. The valve actuator cartridge of claim 13 including a controller operably fluidly coupled to a source of fluid at high pressure and to a source of fluid at substantially ambient pressure, the controller selectively porting fluid at high pressure and venting fluid at substantially ambient pressure from the actuation device.

* * * * *